US006868630B2

(12) United States Patent
Kim

(10) Patent No.: US 6,868,630 B2
(45) Date of Patent: Mar. 22, 2005

(54) PICTURE HOLDING SYSTEM

(76) Inventor: Paul T. Kim, 15029 S. Figueroa St., Gardena, CA (US) 90248

( * ) Notice: Subject to any disclaimer, the term of this patent is extended or adjusted under 35 U.S.C. 154(b) by 77 days.

(21) Appl. No.: 10/634,084

(22) Filed: Aug. 4, 2003

(65) Prior Publication Data

US 2005/0028417 A1 Feb. 10, 2005

(51) Int. Cl.[7] ..... A47G 1/06
(52) U.S. Cl. ..... 40/711; 40/661.01; 40/600
(58) Field of Search ..... 40/700, 711, 661.01, 40/600

(56) References Cited

U.S. PATENT DOCUMENTS

| | | | | | |
|---|---|---|---|---|---|
| 2,649,799 | A | | 8/1953 | Spertus et al. | 40/152 |
| 3,553,872 | A | * | 1/1971 | Ebner | 40/711 |
| 3,553,873 | A | * | 1/1971 | Weston | 40/711 |
| 3,589,049 | A | | 6/1971 | Cornelius et al. | 40/152 |
| 3,707,053 | A | | 12/1972 | Itano | 40/158 |
| 3,885,336 | A | | 5/1975 | Olsen | 40/152 |
| 4,583,309 | A | * | 4/1986 | Kane et al. | 40/711 |
| 5,050,834 | A | | 9/1991 | Tardiff | 248/467 |
| 5,075,991 | A | | 12/1991 | Wenkman et al. | 40/152.1 |
| 5,316,376 | A | | 5/1994 | Defreitas | 301/37.26 |
| 5,502,907 | A | | 4/1996 | Wang | 40/711 |
| 5,522,163 | A | | 6/1996 | Neugebauer | 40/780 |
| 6,067,738 | A | | 5/2000 | Zeligson | 40/611 |
| 6,209,248 | B1 | | 4/2001 | Reinhard | 40/768 |
| D459,881 | S | | 7/2002 | Kim | D3/273 |
| 2003/0121193 | A1 | | 7/2003 | Kim | |
| 2003/0126780 | A1 | | 7/2003 | Kim | |
| 2003/0221349 | A1 | * | 12/2003 | Abe | 40/711 |

* cited by examiner

*Primary Examiner*—Gary C. Hoge
(74) *Attorney, Agent, or Firm*—Park & Sutton LLP; John K. Park

(57) ABSTRACT

A front-loading picture holding system comprising a transparent plate, a support surface supporting the transparent plate and a picture between the transparent plate and the support surface, and a base that receives the transparent plate and the support surface is provided. Magnets are fixed to the transparent plate and the support surface. The support surface has an edge that is located near the perimeter of the support surface and recessed into the rearward of the base. Ferromagnetic body may be used instead of the magnet either in the transparent plate or in the support surface. The transparent plate is removably attached to the support surface by magnetic force between the plate magnet and the corresponding surface magnet, and the transparent plate may be pulled apart by pressing the transparent plate over the edge and pivoting the transparent plate over the support surface.

22 Claims, 3 Drawing Sheets

PICTURE HOLDING SYSTEM

BACKGROUND OF THE INVENTION

The present invention relates to a front-loading picture holding system. More particularly, the invention relates to a picture holding system that is easy and convenient in loading and unloading to and from the front of a picture frame body rather than from the rear of the frame.

Picture holding systems are widely used by many people in our life. However, conventional picture holding systems lack in functions detaching the transparent plate from a support frame in an easy and convenient way, and thus made it difficult, inconvenient and often complicated to load or unload the picture in the picture holding system.

Typical structure of the conventional picture holding systems is to use pivoting fasteners in the backside of the picture holding system and it takes unnecessary time and effort in detaching the transparent plate or the picture, and sometimes, a user has to shake the whole frame body in order to pull out the transparent plate or the picture from the picture holding system. A picture holding system having an easy, simple and convenient structure in detaching the transparent plate or the picture from the base of the picture holding system is desirable.

SUMMARY OF THE INVENTION

The present invention contrives to solve the disadvantages of the prior art. Accordingly, an object of the invention is to provide a picture holding system such that a picture can be loaded and unloaded from the picture holding system in an easy and convenient way.

Another object is to provide the picture holding system that can be integrated to various ornamental objects.

To achieve the above objects, the picture holding system includes a transparent plate and a base that has a support surface supporting the transparent plate and the picture between the transparent plate and the support surface. At least one plate magnet is fixed to a perimetric position of the transparent plate. The support surface has an edge that is located near the perimeter of the support surface and recessed into the rearward of the base, and at lease one surface magnet is fixed to a perimetric position of the support surface.

The transparent plate is removably attached to the support surface by magnetic force between the plate magnet and the corresponding surface magnet, and the transparent plate may be pulled apart by pressing the transparent plate over the edge and pivoting the transparent plate over the support surface. Through above procedure, loading and unloading the picture can be done frontally and conveniently in contrast with the conventional type of picture holding system.

Since the present invention allows loading and unloading the picture from the front of the system, the picture holding system provides a structure such that the picture can be framed frontally in any shape of frame body and therefore this system can be integrated to various ornamental objects that are unable to load the picture from the rear and thus offers wide variety of picture frame designs.

The transparent plate and the support surface may be substantially either flat or curved and the base may be one selected from a frame, a vase, a dish, a box, a lamp stand, etc.

At least one ferromagnetic body may be used instead of the magnet either in the transparent plate or in the support surface, but not both of them at the same time.

The shape of the transparent plate and the support surface may be rectangular, while the edge is located about one of the corners of the support surface or substantially elongated to provide a wider area for pivoting the transparent plate over the support surface.

The shape of the transparent plate and the support surface may be triangular, while the edge is located about one of the corners of the support surface.

The shape of the transparent plate and the support surface plate may be circular, while the edge is located about the periphery of the support surface.

The base has an upper surface and the support surface may be set inwardly from the upper surface to form a depression receiving the transparent plate and the transparent plate may have a top surface such that the top surface is flush with the upper surface.

The support surface may be provided as a separate part from the base.

The advantages of the present invention are: (1) a picture holding system having an easy, convenient and simple structure to load a picture; (2) the picture holding system having an easy, convenient and simple structure to unload the picture; (3) the picture holding system having a structure that can be easily adapted to various ornamental objects; and (4) the picture holding system having a simple structure that needs fewer parts to manufacture.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
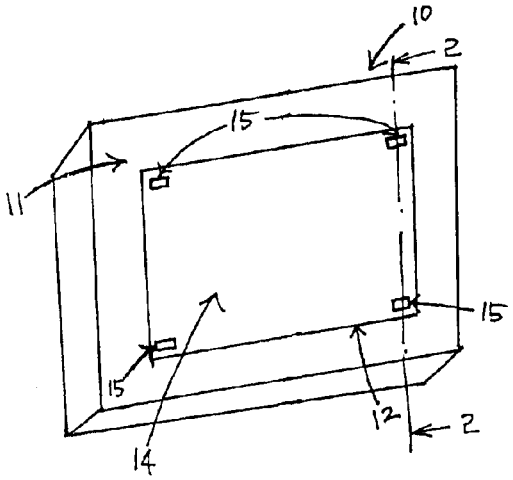
FIG. 1 is an illustrative perspective view of a picture holding system according to the present invention.
Figure 2:
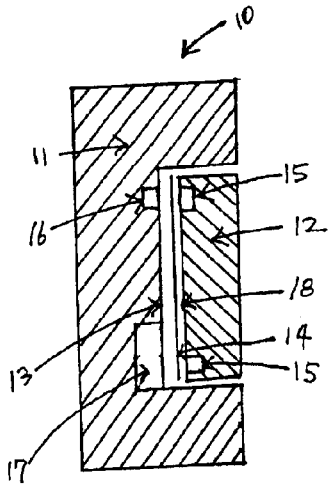
FIG. 2 is a cross-sectional view taken along the line 2—2 in FIG. 1.
Figure 3:
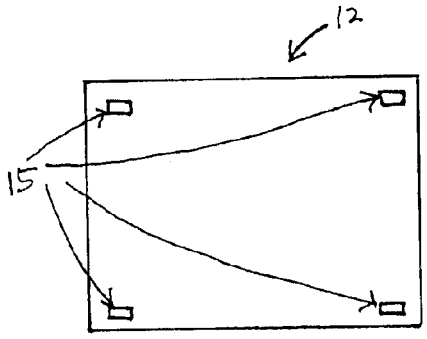
FIG. 3 is a front elevation view of a transparent plate with magnets.
Figure 4:
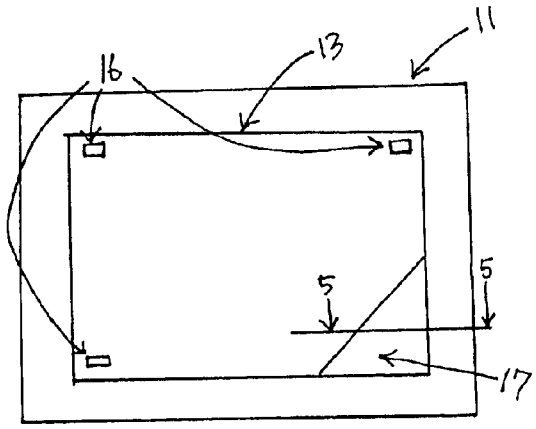
FIG. 4 is a front elevation view of a support surface with magnets and a recessed edge on one of the corners of the support surface.
Figure 5A:
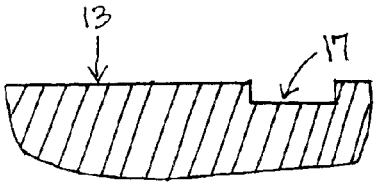
FIG. 5A is a cross-sectional view taken along the line 5—5 in FIG. 4.
Figure 5B:
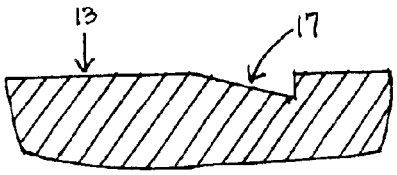
FIG. 5B is a view similar to FIG. 5A but shows a recessed edge that slopes down from the support surface.

FIGS. 1 and 2 show a picture holding system 10 according to the present invention. The picture holding system 10 includes a base 11 and a transparent plate 12 to display a picture 14. The base 11 has a support surface 13 that accepts the transparent plate 12. The support surface 13 supports the picture 14 between the transparent plate 12 and itself. The transparent plate 12 has four plate magnets 15 that are embedded at four perimetric positions of the rear surface 18 of the transparent plate 12 as further shown in FIG. 3. The support surface 13 has three surface magnets 16 that are fixed to three perimetric positions of the support surface 13. The one remaining perimetric position was taken by an edge 17 and recessed into the rearward of the base 11 as further shown in FIGS. 4, 5A and 5B. The surface of the recessed edge 17 may either slope down from the support surface 13 as shown in FIG. 5B or be flat as shown in FIG. 5A. The number of magnet is variable based on the weight, size and shape of the transparent plate 12 and the support surface 13. Ferromagnetic bodies may be used instead of magnets 15 and 16 either in the transparent plate 12 or in the support surface 13, but not both of them at the same time. The transparent plate 12 is removably attached to the support surface 13 by magnetic force between the plate magnets 15 and the corresponding surface magnets 16, and the transparent plate 12 may be pulled apart by pressing the transparent plate 12 over the edge 17 and pivoting the transparent plate 12 over the support surface 13.

Figure 6:
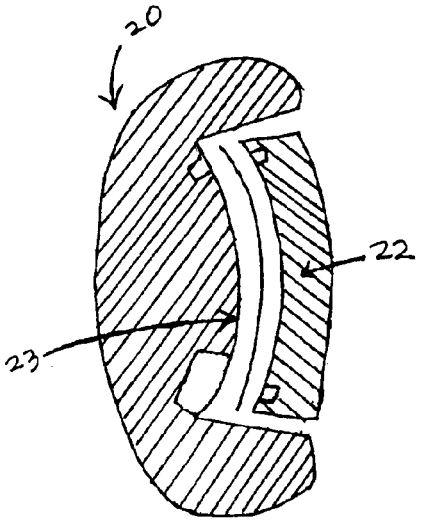
FIG. 6 is a view similar to FIG. 2 but shows the transparent plate and the support surface are curved.

Another embodiment of picture holding system 20 is shown in FIG. 6. In the embodiment, the picture holding system 20 includes a curved transparent plate is 22 and a curved support surface 23. This embodiment is very useful when the picture holding system is integrated into an object that has a curved surface.

Figure 7:
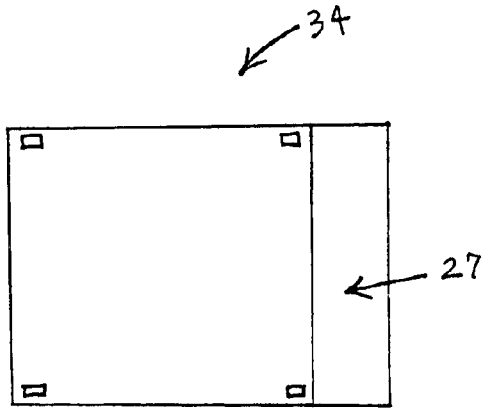
FIG. 7 is a front elevation view of a rectangular support surface with the magnets and a recessed edge on one of the sides of the support surface.

FIG. 7 shows another type of edge 27 that is elongated to provide a wider area for pivoting a transparent plate over a support surface 34.

Figure 8:
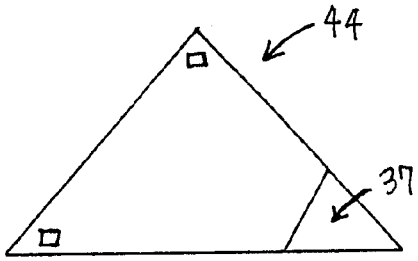
FIG. 8 is a front elevation view of a triangular support surface with a recessed edge on one of the corners of the support surface.
Figure 9:
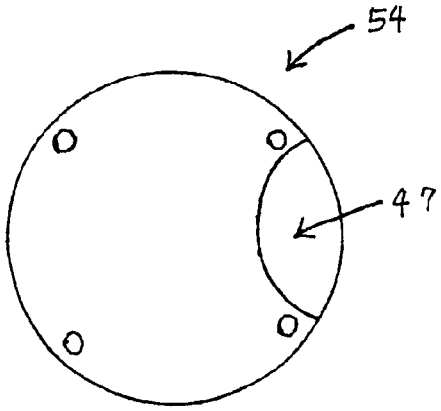
FIG. 9 is a front elevation view of a circular support surface with a recessed edge on the periphery of the support surface.

Various shapes of support surfaces and recessed edges are possible. The shape of the support surface in FIG. 8 is triangular and a recessed edge 37 is located on one of the corners of the support surface 44. The shape of the support surface in FIG. 9 is circular and a recessed edge 47 is located on the periphery of the support surface 54.

Figure 11:
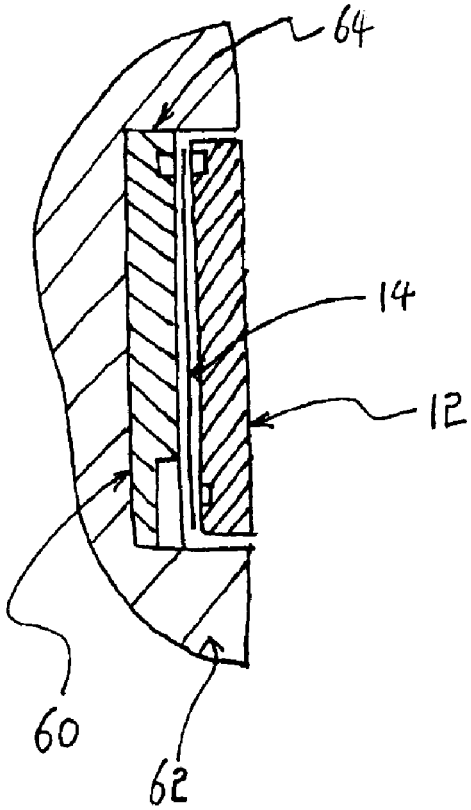
FIG. 11 is a view similar to FIG. 2 but shows that a support surface is separately provided and received in a base.

FIG. 11 shows a support surface 60 is provided as a separate part and a base 62 has a depression 64 that receives the support surface 60 and the transparent plate 12. The transparent plate 12 is flush with the base 62 around the depression 64.

Figure 10:
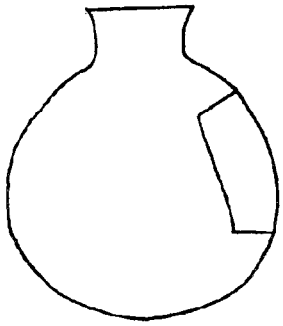
FIG. 10 is an illustrative perspective view of a picture holding system provided for a vase.

The picture holding system can be integrated to various ornamental objects and one example of a vase type is shown in FIG. 10.

With the above construction, a user can load and unload a picture in a picture holding system in an easy, simple and convenient way and this system can be applied to various types of bases including a frame, a vase, a dish, a lamp stand and etc.

Although the invention has been described in considerable detail, other versions are possible by converting the aforementioned construction. Therefore, the scope of the invention shall not be limited by the specification specified above.

What is claimed is:

1. A picture holding system comprising:

a) a transparent plate, wherein at least one plate magnet is fixed to a perimetric position of the transparent plate; and b) a base comprising a support surface that accepts the transparent plate and supports a picture between the transparent plate and the support surface, wherein the support surface has a recess located near a perimeter of the support surface, the recess having an edge, wherein at least one surface magnet is fixed to a perimetric position of the support surface; and wherein a portion of the transparent plate overhangs the recess in the support surface, and the transparent plate is removably attached to the support surface by magnetic force between the plate magnet and the corresponding surface magnet, and wherein the transparent plate may be pulled apart by pressing the portion of the transparent plate that overhangs the recess and pivoting the transparent plate over the edge of the recess.

2. The picture holding system of claim 1, wherein the transparent plate and the support surface are substantially flat.

3. The picture holding system of claim 1, wherein the transparent plate and the support surface are substantially curved.

4. The picture holding system of claim 1, wherein the base is one selected from a frame, a vase, a dish, a box and a lamp stand.

5. The picture holding system of claim 1, wherein the transparent plate and the support surface are substantially rectangular and the recess is located at one of the corners of the support surface.

6. The picture holding system of claim 5, wherein the edge is substantially elongated to provide a wider area for pivoting the transparent plate over the support surface.

7. The picture holding system of claim 1, wherein the transparent plate and the support surface are substantially triangular and the recess is located at one of the corners of the support surface.

8. The picture holding system of claim 1, wherein the shape of the transparent plate and the support surface are circular and the recess is located on the periphery of the support surface.

9. The picture holding system of claim 1, wherein the base has an upper surface, wherein the support surface is set inwardly from the upper surface to form a depression receiving the transparent plate.

10. The picture holding system of claim 9, wherein the transparent plate has a top surface such that the top surface is flush with the upper surface.

11. A picture holding system comprising:

a) a transparent plate, wherein at least one ferromagnetic body is fixed to a perimetric position of transparent plate; and b) a base comprising a support surface that accepts the transparent plate and supports a picture between the transparent plate and the support surface, wherein the support surface has a recess located near a perimeter of the support surface, the recess having an edge, wherein at least one surface magnet is fixed to a perimetric position of the support surface; and wherein a portion of the transparent plate overhangs the recess in the support surface, and the transparent plate is attached to the support surface by magnetic force between the ferromagnetic body and the corresponding surface magnet, and wherein the transparent plate may be pulled apart by pressing the portion of the transparent plate that overhangs the recess and pivoting the transparent plate over the edge of the recess.

12. The picture holding system of claim 11, wherein the transparent plate and the support surface are substantially flat.

13. The picture holding system of claim 11, wherein the transparent plate and the support surface are substantially curved.

14. The picture holding system of claim 11, wherein the base has an upper surface, wherein the support surface is set inwardly from the upper surface to form a depression receiving the transparent plate.

15. The picture holding system of claim 11, wherein the transparent plate has a top surface such that the top surface is flush with the upper surface.

16. A picture holding system comprising:

a) a transparent plate, wherein at least one plate magnet is fixed to a perimetric position of transparent plate; and b) a base comprising a support surface that accepts the transparent plate and supports a picture between the transparent plate and the support surface, wherein the support surface has a recess located near a perimeter of the support surface, the recess having an edge, wherein at least one ferromagnetic body is fixed to a perimetric position of the support surface; and wherein a portion of the transparent plate overhangs the recess in the support surface, and the transparent plate is attached to the support surface by magnetic force between the plate magnet and the corresponding ferromagnetic body, and wherein the transparent plate may be pulled apart by pressing the portion of the transparent plate that overhangs the recess and pivoting the transparent plate over the edge of the recess.

17. The picture holding system of claim 16, wherein the transparent plate and the support surface are substantially flat.

18. The picture holding system of claim 16, wherein the transparent plate and the support surface are substantially curved.

19. The picture holding system of claim 16, wherein the base has an upper surface, wherein the support surface is set inwardly from the upper surface to form a depression receiving the transparent plate.

20. The picture holding system of claim 16, wherein the transparent plate has a top surface such that the top surface is flush with the upper surface.

21. A picture holding system comprising:

a) a transparent plate, wherein at least one plate magnet is fixed to a perimetric position of the transparent plate; and b) a support surface that accepts the transparent plate and supports a picture between the transparent plate and the support surface, wherein the support surface has an edge located near the perimeter of the support surface and recessed to form a cavity, wherein at least one surface magnet is fixed to a perimetric position of the support surface; and c) a base that has a depression that receives the support surface and the transparent plate; and wherein the transparent plate is removably attached to the support surface by magnetic force between the plate magnet and the corresponding surface magnet, and the transparent plate may be pulled apart by pressing the transparent plate over the edge and pivoting the transparent plate over the support surface.

22. The picture holding system of claim 21, wherein the transparent plate is flush with the base.

* * * * *